US007814756B2

(12) United States Patent
Masui

(10) Patent No.: US 7,814,756 B2
(45) Date of Patent: Oct. 19, 2010

(54) AIR-CONDITIONING SYSTEM

(75) Inventor: Hirotaka Masui, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 810 days.

(21) Appl. No.: 11/791,949

(22) PCT Filed: Sep. 20, 2006

(86) PCT No.: PCT/JP2006/318558

§ 371 (c)(1),
(2), (4) Date: May 31, 2007

(87) PCT Pub. No.: WO2008/035402

PCT Pub. Date: Mar. 27, 2008

(65) Prior Publication Data

US 2009/0139251 A1 Jun. 4, 2009

(51) Int. Cl.
*F25B 49/00* (2006.01)
*G05D 23/00* (2006.01)
*G01M 1/38* (2006.01)

(52) U.S. Cl. ..... 62/132; 236/51; 700/276

(58) Field of Classification Search ..... 62/132, 62/129, 126; 236/51; 700/276, 291
See application file for complete search history.

(56) References Cited

U.S. PATENT DOCUMENTS

| | | | |
|---|---|---|---|
| 5,936,211 | A | 8/1999 | Kim |
| 2001/0003906 | A1 | 6/2001 | Roh |
| 2005/0005619 | A1 | 1/2005 | Kojima et al. |

FOREIGN PATENT DOCUMENTS

| | | | |
|---|---|---|---|
| DE | 100 57 219 | | 8/2001 |
| EP | 1 653 161 | | 5/2006 |
| JP | 04-121547 | | 4/1992 |
| JP | 07-305886 | | 11/1995 |
| JP | 8-86497 | A | 4/1996 |
| JP | 8-219532 | A | 8/1996 |
| JP | 10-182023 | | 7/1998 |
| JP | 2003-065588 | A | 3/2003 |
| JP | 2003-106621 | A | 4/2003 |
| JP | 2003-130435 | A | 5/2003 |
| JP | 2003-307335 | A | 10/2003 |
| JP | 2004-316995 | A | 11/2004 |
| JP | 2006-211113 | A | 8/2006 |

OTHER PUBLICATIONS

Supplementary European Search Report issued in corresponding Application No. 06798119.1-2301 dated Oct. 22, 2009.

*Primary Examiner*—Chen-Wen Jiang
(74) *Attorney, Agent, or Firm*—Buchanan Ingersoll & Rooney PC

(57) ABSTRACT

An air-conditioning system capable of reducing traffic of signals and effectively performing control and management operations without causing heavy traffic is obtained. In an air-conditioning system including one or more indoor units 200, one or more outdoor units 100, and a centralized control apparatus 300 and performing signal communication, a transmission relay 400 is provided between a first transmission line 500 to which the one or more outdoor units 100 and the centralized control apparatus 300 are connected and a second transmission line 510 to which one or more indoor units 200 constituting a group are connected, the transmission relay 400 relays a signal between the first transmission line 500 and the connected second transmission line 510. The transmission relay 400 further includes arithmetic processing means 430 for processing data included in the signal transmitted via the connected second transmission line 510, and data storage means 440 for storing data regarding the processing by the arithmetic processing means 430.

9 Claims, 12 Drawing Sheets

(a)

| OUTDOOR UNIT | 100a | 100b |
|---|---|---|
| INDOOR UNIT | 200a, 200b | 200a, 200b |

(b)

| OUTDOOR UNIT | 100a | 100b |
|---|---|---|
| INDOOR UNIT | 200e, 200f | 200g, 200h |

AIR-CONDITIONING SYSTEM

TECHNICAL FIELD

The present invention relates to an air-conditioning system that controls indoor units and outdoor units with a centralized control apparatus. In particular, the present invention relates to communication of signals including data among the indoor units, the outdoor units, and the centralized control apparatus.

BACKGROUND ART

For example, in the architecture such as buildings, there are air-conditioning systems configured to control a plurality of indoor units, each of which is installed indoors and adjust the room temperature to an instructed temperature, and a plurality of outdoor units, each of which is installed outdoors and exhaust heat, with a centralized control apparatus. At this time, the outdoor units, the indoor units, and the centralized control apparatus are connected by transmission lines or the like to constitute a network. For example, each of the units or the apparatus transmits various signals including control data such as (operation on/off signals, set temperature differences, and operation modes), and performs communication.

Conventionally, in the air-conditioning systems, for example, the centralized control apparatus and each of the outdoor units are connected by transmission lines. The centralized control apparatus is further connected to indoor units, each linked to a corresponding one of the outdoor units by piping, by a repeater included in each of the outdoor units. In such a manner, a large network is often constructed with bus connection. Thus, if one of the units or apparatus that is connected to the network attempts to transmit a signal to another unit or apparatus, the signal is transmitted to all of the units and the apparatus. One signal occupies the entire network of the air-conditioning system (each of the units or the apparatus determines whether the signal is transmitted thereto, and the unit or the apparatus that has determined that the signal is transmitted thereto performs processing based on the signal). Accordingly, if the number of connected units is increased, or if signals are exchanged more frequently using a more advanced management system, traffic of signals transmitted over the network increases. If the traffic becomes saturated and the network occupied state continues, units unable to transmit a signal may emerge, for example. For this reason, for example, the centralized control apparatus cannot perform an effective management on the units or the room temperature adjustment.

Accordingly, for example, there is an air-conditioning system having a network configuration in which one or more networks, which are constituted by connecting one or more indoor units by transmission lines, are connected to a network, which are constituted by connecting a centralized control apparatus and each of outdoor units by a transmission line, through a bridge (see, for example, Patent Document 1). The network configuration in this air-conditioning system is designed to resolve heavy traffic over the network in the system by preventing unnecessary signals from being transmitted to other networks. In addition, by configuring the network in such a manner, communication can be performed at a communication speed suitable for a small networking environment. For example, a communication speed over the transmission line interconnecting the centralized control apparatus and each of the outdoor units may be increased.

Patent Document 1: Japanese Unexamined Patent Application Publication No. 2004-316995

DISCLOSURE OF INVENTION

Problems to be Solved by the Invention

Like the above-described air-conditioning system, by providing a bridge, it is possible to prevent unnecessary signals from being transmitted to apparatuses that do not need to receive the signals and to prevent the entire network of the system from being occupied by one signal.

However, in the above-described air-conditioning system, since many of communications in the system are those performed with a centralized control apparatus, traffic over a signal transmission line between the centralized control apparatus, outdoor units, and bridge does not decrease significantly, which does not result in resolving heavy traffic. For this reason, as a result, the communication in the entire system is not performed effectively, which affects the management.

Accordingly, it is an object of the present invention to provide an air-conditioning system capable of reducing traffic of signals transmitted over a network (particularly, among the centralized control apparatus, the outdoor units, and the bridge) and effectively performing control and management operations without causing heavy traffic.

Means for Solving the Problems

An air-conditioning system according to the present invention includes one or more indoor units, one or more outdoor units, and a centralized control apparatus. Each of the units and apparatus includes communication means for transmitting and receiving signals to perform signal communication. In the air-conditioning system, a transmission relay is provided between a first transmission line to which the one or more outdoor units and the centralized control apparatus are connected and a second transmission line to which one or more indoor units constituting a group are connected. The transmission relay relays a signal between the first transmission line and the connected second transmission line. Furthermore, the transmission relay includes arithmetic processing means for processing data included in the signal transmitted via the connected second transmission line, and data storage means for storing data regarding the processing by the arithmetic processing means.

ADVANTAGES

According to the present invention, since the arithmetic processing means for performing data processing is provided in the transmission relay and the arithmetic processing means is configured to process the data included in the signal transmitted from the connected second transmission means, the transmission relay performs all of or part of operations for processing various data that the centralized control apparatus performs. With this configuration, it is possible to reduce the traffic between each of the indoor units and the centralized control apparatus. Accordingly, the traffic over the first transmission line is reduced in comparison with a conventional system and heavy traffic can be avoided. In addition, each of the plurality of transmission relays processes the data, whereby the processing load can be distributed and the load of the processing that the centralized control apparatus performs can be reduced.

BEST MODE FOR CARRYING OUT THE INVENTION

FIG. 1 is a diagram showing a configuration of an air-conditioning system according to an embodiment 1 of the present invention. Firstly, regarding a refrigerant system of the system of FIG. 1, an outdoor unit 100*a* and indoor units 200*a*, 200*b*, 200*e*, and 200*f* are connected through a refrigerant piping 600*a* to constitute a refrigeration cycle. In addition, an outdoor unit 100*b* and indoor units 200*c*, 200*d*, 200*g*, and 200*h* are connected through a refrigerant piping 600*b* to constitute a refrigeration cycle. Here, in FIG. 1, the refrigerant piping 600*a* or 600*b* is denoted by one line. However, in practice, the refrigerant piping may be constituted by at least two pipes to circulate refrigerant.

Additionally, regarding a power system of the system, the outdoor units 100*a* and 100*b* are connected to a power supply through a power line 700 to receive electric power. The indoor units 200*a*, 200*b*, 200*c*, and 200*d* are connected to a power supply through a power line 710*a*. Furthermore, the indoor units 200*e*, 200*f*, 200*g*, and 200*h* are connected to a power supply through a power line 710*b* to receive electric power (hereinafter, those elements are representatively denoted as an outdoor unit 100, an indoor unit 200, a refrigerant piping 600, and a power line 710, when distinction thereof is not needed in particular).

Next, a communication system in the system in the embodiment will be described. Firstly, a centralized control apparatus 300 and the outdoor units 100*a* and 200*b* are connected through a first transmission line 500. In addition, transmission relays 400*a* and 400*b* that perform a signal relay operation between the transmission line and the indoor units 200*a* to 200*h* are also connected to the first transmission line 500. Here, it is assumed that communication among the centralized control apparatus 300, the outdoor units 100*a* and 100*b*, and the transmission relays 400*a* and 400*b* that are connected to the first transmission line 500 can be performed at a high speed (data traffic per unit of time is large). Regarding realization of high-speed data communication, various methods, such as materials of the transmission line and data multiplexing, can be considered. However, the methods are not specified herein in particular.

Furthermore, in this embodiment, the indoor units 200*a*, 200*b*, 200*c*, and 200*d* are connected to the transmission relay 400*a* through a second transmission line 301*a*. In addition, the indoor units 200*e*, 200*f*, 200*g*, and 200*h* are connected to the transmission relay 400*b* through a second transmission line 510*b* (hereinafter, each of those elements is denoted as a transmission relay 400 and a second transmission line 510, when distinction thereof is not needed in particular). Herein, in this embodiment, for example, suppose that the indoor units 200 (only one indoor unit 200 may be installed) installed on each story (floor) of a building constitute a group, and each of groups is connected to the corresponding one of transmission relays 400 through the second transmission line 510. However, the configuration is not limited to this example. For example, since traffic over the second transmission line 510 increases as the number of communication connections increases, the indoor units 200 installed even in the same floor may be divided into a plurality of groups to resolve the heavy traffic. In addition, the group configuration of the communication system is not necessarily the same as the group configuration of the refrigerant system as shown in FIG. 1, and the configurations may differ. Additionally, in FIG. 1, although the group configuration of the communication system is the same as the group configuration of the power system, these configurations are not necessarily the same and may differ.

At this time, the communication through the second transmission line 510 may be performed at a high speed as in the case of the communication through the first transmission line 500. However, considering this by comparing the traffic with that over the first transmission line 500, it is considered that the speed of the communication among the indoor units 200 is not necessarily set to be particularly high. For this reason, in this embodiment, it is assumed that the speed of the communication through the second transmission line 510 is lower than that of the communication through the first transmission line 500. Accordingly, indoor unit communication means 500 in each indoor unit 200 and the second transmission line 510 are not necessarily constituted by high-cost means corresponding to the speed of the communication performed through the first transmission line 500, which can suppress the cost of the entire system. In addition, in this embodiment, suppose that signal protocols may differ between the first transmission line 500 and the second transmission lines 510*a* and 301*b*. Accordingly, the transmission relays 400*a* and 400*b* perform a protocol conversion operation on the signals received from one transmission line, and transmit the converted signals to the other transmission line. Kinds of protocols employed in each apparatus in the system are not particularly specified.

FIG. 2 is a diagram showing an example of a configuration of the outdoor unit 100. Outdoor unit controlling means 110 controls operations of each means constituting the outdoor unit 100 on the basis of signals or the like received by outdoor unit communication means 120 from the centralized control apparatus 300 or the like. The outdoor unit communication means 120 is connected to the first transmission line 500 and serves as a signal communication interface between the first transmission line 500 and the outdoor unit controlling means 110. Outdoor unit storage means 130 stores data needed by the outdoor unit controlling means 110 to perform processing. Here, the outdoor unit storage means 130 stores an address unique in the system as data (hereinafter, referred to as an address). This address is the address indicating a destination or a source of the signal transmission for performing the communication, for example. In addition, the outdoor unit storage means 130 also stores data representing a relationship in the refrigerant system described below.

A compressor 140 compresses sucked refrigerant (gas), and sends out (exhales) the refrigerant after applying a predetermined pressure based on an operation frequency to the refrigerant. For example, it may be a variable volume type compressor equipped with an inverter circuit to change a volume (a volume of the refrigerant sent out per unit of time) by arbitrarily changing the operation frequency, but it is not limited to this. An outdoor-unit-side heat exchanger 150 performs a heat exchange operation between the refrigerant and air passing through the heat exchanger. An outdoor-unit-side fan 160 sends air used for the heat exchange into the outdoor-unit-side heat exchanger 150, for example. A four-way switching valve 170 is a valve for switching a piping path in accordance with, for example, a cooling operation or a heating operation. An accumulator (a liquid separator) 180 is a device causing the compressor 160 to inhale the gas refrigerant. In addition, an outdoor-unit-side expansion valve 190 adjusts valve opening on the basis of an instruction of the outdoor unit controlling means 110 to control a flow rate of the refrigerant.

FIG. 3 is a diagram showing an example of a configuration of the indoor unit 200. Indoor unit controlling means 210 controls operation of each means constituting the indoor unit 200 on the basis of, for example, instruction signals from operation input means 240 and signals that the indoor unit communication means 220 receives. Here, the indoor unit controlling means 210 has a quartz oscillator 211 that generate a clock used as a reference of the operations. The indoor unit communication means 220 is connected to the first transmission line 500 and serves as a signal communication interface between the second transmission line 510 and the indoor unit controlling means 210. Indoor unit storage means 230 stores data needed by the indoor unit controlling means 210 to perform processing. Like the outdoor unit storage means 130, the indoor unit storage means 230 stores an address in the system and data representing a relationship in the refrigerant system. The operation input means 240 transmits instructions, such as temperature settings and operation modes, input by, for example, operators through a remote controller, to the indoor unit controlling means 210 as signals.

An indoor-unit-side heat exchanger 250 performs a heat exchange operation between the refrigerant and the air passing through the heat exchanger. An indoor-unit-side fan 260 sends air into the indoor-unit-side heat exchanger 250 to exchange heat and sends out heat exchanged air to a room. An indoor-unit-side expansion valve 270 adjusts valve opening on the basis of an instruction of the indoor unit controlling means 210 to control a flow rate of the refrigerant, thereby controlling the volume of the refrigerant passing through the indoor-unit-side heat exchanger 250 and adjusting vaporization of the refrigerant in the indoor-unit-side heat exchanger 250. An auxiliary heater 280 additionally heats the air if the air heated at a predetermined temperature cannot be sent out only by the heat exchange in the indoor-unit-side heat exchanger 250 when sending out the warm air to the room in the heating operation, for example.

FIG. 4 is a diagram showing a configuration of the transmission relay 400. First transmission means 410 is connected to the first transmission line 500 and serves as a signal communication interface between the first transmission line 500 and arithmetic processing means 430. In addition, second transmission means 420 is also connected to the second transmission line 510, and servers as a signal communication interface between the second transmission line 510 and the arithmetic processing means 430.

The arithmetic processing means 430 is further constituted by a relay processing unit 430A and a data processing unit 430B, and performs processing on the basis of signals that the first transmission means 410 and the second transmission means 420 receive. The relay processing unit 430 determines whether to transmit the signal from the first transmission line 500, which the first transmission means 410 has received, to the second transmission line 510 through the second transmission means 420. Conversely, the relay processing unit 430 determines whether to transmit the signal from the second transmission line 510, which the second transmission means 420 has received, to the first transmission line 500 through the first transmission means 410. If the relay processing unit 430 has determined to transmit the signal, the relay processing unit 430 performs signal protocol conversion, and causes the first transmission means 410 or the second transmission means 420 to transmit the converted signal. Here, depending on circumstances, the relay processing unit 430 not only perform the signal protocol conversion but also converts the protocol of the data included in the signal.

The data processing unit 430B performs processing for transmitting a polling signal to each of the indoor units 200 connected through, for example, the second transmission line 510 to cause the second transmission means 420 to transmit the signal. The data processing unit 430B process the data included in the signal transmitted from each of the indoor units 200 as a reply and stores the data in, for example, the data storage means 440. In this embodiment, suppose that data regarding electric power (energy) consumption used in each of the indoor units 200 is included in the transmitted signal. Furthermore, for example, the data processing unit 430B performs processing for transmitting the signal including the data stored in the data storage means 440 to the centralized control apparatus 300 through the first transmission line 500, regularly or upon determining that an instruction for signal transmission is received from the centralized control apparatus 300, and causes the first transmission means 410 to transmit the signal.

Here, each processing unit in the arithmetic processing means 430 may be constituted by different hardware. However, for example, each processing unit may be constituted by an arithmetic and control means (a computer) such as a CPU (Central Processing Unit), in which a procedure thereof is programmed in advance on the other hand, so that the processing units are constituted by software, firmware, or the like. The arithmetic and control means executes the program and performs processing based on the program to realize the processing performed by each of the above-described units. Data of these programs may be stored in, for example, the data storage means 440.

FIG. 5 is diagrams showing a relationship in the refrigerant system. The data storage means 440 stores the data needed by the arithmetic processing means 430 to perform processing. In addition, the data storage means 440 stores data, such as results of the processing that each control unit in the arithmetic processing means 430 has performed. For example, the data storage means 440 stores conversion data used by the relay processing unit 430A to perform the protocol conversion operation.

Additionally, in this embodiment, the relationship in the above-described refrigerant system is stored in a system storage unit 441, for example, as data in a table format. Each transmission relay 400 stores a relationship between each indoor unit 200 and the outdoor unit 100 linked to the indoor unit by the refrigerant piping in a refrigerant system storage unit 441 regarding the indoor units 200 connected to the transmission relay 400 through the second transmission line 510. More specifically, the transmission relay 400*a* stores data shown in FIG. 5(*a*) in the system storage unit 441, whereas the transmission relay 400*b* stores data shown in FIG. 5(*b*) in the system storage unit 441. In addition, in the system storage unit 441, address data in the communication system (including data thereabout (the transmission relay 400)) is also stored, and is associated with the refrigerant system data regarding the outdoor units 100 and the indoor units 200. The data stored in the system storage unit 441 is the data used by the relay processing unit 430A to determine whether to perform the signal relay operation.

The refrigerant system data is set and stored, for example, in the centralized control apparatus 300. The centralized control apparatus 300 transmits a signal including the refrigerant system data to each transmission relay 400 through the first transmission line 500. On the basis of the signal that the first transmission means 410 has received, the data processing unit 430B processes the refrigerant system data and stores the data in the system storage unit 441.

Moreover, in this embodiment, the data regarding used electric power included in the signal transmitted from each indoor unit 200 through the second transmission line 510 is stored in the data storage means 440. Here, the data regarding the used electric power includes, for example, data about the opening of the indoor-unit-side expansion valve 270 (an amount of used refrigerant), data about an operating time of the indoor-unit-side fan 260, data about an operating time of the auxiliary heater 280, and data about a turning-on time of thermostat. For example, a group may be constituted by a plurality of indoor units 200. Data regarding the sum of data about the electric power used in the group, for example, may be stored. However, in this embodiment, the data regarding the used electric power is stored for each indoor unit 200.

In the air-conditioning system installed in a building, the centralized control apparatus 300 processes the data included in the signal transmitted from each indoor unit 200, and stores the processing results in storage means 405 or displays the result on display means 406, for example. At this time, the signals transmitted from all of the indoor units 200 are transmitted to the centralized control apparatus 300 through the first transmission line 500. Thus, as the number of the indoor units 200 in the system increases, the traffic over the first transmission line 500 increases and heavy traffic is caused. Accordingly, in the air-conditioning system according to the embodiment, the data processing unit 430B for performing data processing is provided in the transmission relay 400, and the transmission relay 400 is configured to perform all or part of processing of various data (in the embodiment, monitoring (watching) processing such as data collection using a polling method) that the centralized control apparatus 300 performs. In this case, the transmission relay 400 performs an operation for collecting data regarding the electric power used in each indoor unit 200. The data processing that the transmission relay performs is not limited to the data collection operation using the polling method, and other data processing may be performed.

In the air-conditioning system for a building used by a plurality of users (tenants), the power rate for the air-conditioning system has to be divided proportionally among the plurality of users in accordance with the power consumption. Accordingly, if the centralized processing apparatus 300 performs the data collection and data storage (accumulation) operation according to the polling method, signals requesting signal transmission (request signals) and reply signals (signals including data regarding the used electric power) are communicated over the first transmission line 500. For example, if data of each of dozens of indoor units 200 is collected every minute, the data collection has to be continuously performed at intervals of an average of 1 second. Furthermore, as the number of indoor units increases, the traffic over the first transmission line 500 increases, which affects signal transmission for a primary air-conditioning control operation. Accordingly, in this embodiment, each transmission relay 400 performs the data collection. For example, each transmission relay 400 transmits a signal including data regarding the used electric power to the centralized processing apparatus 300 regularly or when the transmission of the signal is requested from the centralized control apparatus 300.

Communication in the air-conditioning system according to the embodiment will be described next. The description is centered on operations of communication through the transmission relay 400, in particular. Firstly, the relay operation that the transmission relay 400 performs will be described, taking the transmission/reception of signal between the indoor unit 100*a* and the outdoor unit 200*a* for example. For example, when the outdoor unit 100*a* transmits a signal including data to the indoor unit 200*a*, the signal is transmitted from the outdoor unit communication means 120 included in the outdoor unit 100*a*. Here, it is assumed that the data included in the signal communicated through each transmission line includes not only data regarding the instruction, control, and management for each unit (processing data) but also data regarding a source and a destination of the transmission (hereinafter, the same assumption follows).

The signal is transmitted to the outdoor unit 100*b*, the centralized control apparatus 300, and the transmission relays 400*a* and 400*b* through the first transmission line 500. On the basis of the data of the transmission destination included in the signal that the first transmission means 410 of the transmission relay 400*a* has received, the relay processing unit 430A of the transmission relay 400*a* retrieves in the refrigerant system storage unit 441 to determine whether the destination is the indoor unit 200 connected thereto through the second transmission line 510*a* (whether the relay processing unit has to perform the relay processing). In the refrigerant system storage unit 441 of the transmission relay 400*a*, as described above, the data regarding the indoor unit 200*a* is stored as the refrigerant system data. Thus, the relay processing unit 430A determines that the indoor unit 200*a* is connected thereto through the second transmission line 510*a*, and causes the second transmission means 420 to transmit the signal after performing the protocol conversion operation. On the other hand, the outdoor unit 100*b*, the centralized control apparatus 300, and the transmission relay 400*b* also determine whether they have to perform the relay processing on the basis of the data of the transmission destination included in the signal. However, these apparatuses do not perform the following processing since there is no need for performing the processing.

Each indoor unit communication means 500 of the indoor units 200*a*, 200*b*, 200*c*, and 200*d* receives the signal transmitted from the second transmission means 420 through the second transmission line 510*a*. On the basis of the data of the transmission destination included in the signal, the indoor unit controlling means 210 of each indoor unit 200 determines whether it has to process the signal. The indoor unit 200*a* determines that the signal is transmitted thereto and performs processing based on the processing data included in the signal. On the other hand, other indoor units 200 determine that there is no need for performing the processing, and do not perform the processing.

Conversely, for example, when the indoor unit 200*a* transmits a signal to the outdoor unit 100*a*, the indoor unit communication means 500 of the indoor unit 200*a* transmits the signal. The indoor unit communication means of each of the indoor units 200*b*, 200*c*, and 200*d*, and the second transmission means 420 of the transmission relay 400*a* receive the signal transmitted through the second transmission line 510*a*. On the basis of the data of the transmission destination included in the signal, each of the indoor units 200*b*, 200*c*, 200*d*, and the transmission relay 400*a* determines whether it has to perform the processing. The indoor units 200*b*, 200*c*, and 200*d* determine that there is no need for performing the processing, and do not perform the processing. On the other hand, the relay processing unit 430A of the transmission relay 400*a* retrieves information in the refrigerant system storage unit 441. Upon determining that the transmission destination is the outdoor unit 200*a*, the relay processing unit 430A causes the first transmission means 410 to transmit the signal having undergone the protocol conversion operation.

The outdoor unit communication means 120 of the outdoor units 100*a* and 200*b*, the centralized control apparatus 300 (communication means thereof), and the first transmission means 410 of the transmission relay 400*b* receive the signal transmitted from the first transmission means 410 through the first transmission line 500. The outdoor units 100*a* and 200*b*, the centralized control apparatus 300, and the transmission relay 400*b* determine whether they have to process the data on the basis the data of the transmission destination included in the signal. The outdoor unit 100*a* determines that the signal is transmitted thereto, and performs processing based on the processing data included in the signal. Other apparatuses determine that there is no need for performing the processing, and do not perform the processing. The communication among other outdoor units 100, the centralized control apparatus 300, and the indoor units 200 is performed in the same manner.

FIG. 6 is a diagram showing an example of the data processing centered on the data processing unit 430B of the transmission relay 400. An example of an operation performed by the transmission relay 400 to collect and store data regarding used electric power will be described next. Firstly, the data processing unit 430B of the arithmetic processing means 430 causes the second transmission means 420 to transmit a signal including an instruction requesting data regarding the used electronic power (hereinafter, referred to as a request signal) to an indoor unit 200 (e.g., the indoor unit 200*a*) (request signal transmission operation: S11).

On the indoor unit 200 side, on the basis of the request signal received by the indoor unit communication means 220, the indoor unit controlling means 210 performs an operation for detecting data set as the data regarding the used electric power (S21). The indoor unit controlling means 210 causes the indoor unit communication means 220 to transmit a signal including data regarding the used electric power (data signal transmission operation: S22).

On the basis of the signal that the second transmission means 420 has received, the data processing unit 430B stores the data regarding the used electric power in the data storage means 440 (data collection and storage operation: S12). Then, request signal transmission operation is performed for other indoor units 200 (e.g., the indoor unit 200*b*) (S11), and the data regarding the used electric power is collected and stored. The above-described operation is repeatedly performed so that the data regarding the electric power used in each indoor unit 200 is stored at intervals of one minute.

The centralized control apparatus 300 transmits a signal for instructing transmission to each transmission relay 400, for example, regularly (data signal transmission instructing operation: S31). In the transmission relay 400, upon receiving the signal from the centralized control apparatus 300, the data processing unit 430B causes the first transmission means 410 to transmit a signal including the data regarding the used electric power stored in the data storage means 440 (data signal transmission operation: S13). At this time, the traffic over the first transmission line 500 can be further reduced by transmitting a signal including the data having undergone a compression operation, for example. On the basis of the data regarding the used electric power by each transmission relay 400, the centralized control apparatus 300 proportionally divides the power rate for the air-conditioning system for, for example, each tenant user (dividing operation S32).

In the above description, although the request signal is transmitted to each indoor unit 200 connected to the second transmission line 510, the present invention is not limited to this configuration. For example, signal transmission timings may be set for each indoor unit 200 in advance. Each indoor unit 200 having received the request signal may be configured to perform the signal transmission at the corresponding transmission timing. By this configuration, each indoor unit 200 can transmit the signal including the data regarding the used electric power to the transmission relay 400 with one request signal but without causing signal collision in the transmission of the signal including the data regarding the used electric power. In addition, data to be collected and the collection procedure are not limited to the above example.

As described above, according to the air-conditioning system of the embodiment 1, the data processing unit 430B for performing data processing is provided in the transmission relay 400. The transmission relay 400 is configured to perform all or part of the processing of various data that the centralized control apparatus 300 performs. Thus, the traffic of the communication performed between each indoor unit 200 and the centralized control apparatus 300 can be reduced. Accordingly, the traffic over the first transmission line 500 is reduced when compared with the conventional one, and it is possible to prevent the heavy traffic from being caused. In the system of the embodiment, since the transmission relay 400 is configured to perform the monitoring (watching) operation such as data collection using the polling method, the number of times of communication between each indoor unit 200 and the centralized control apparatus 300 can be reduced. In particular, the data regarding the used electric power is limitedly used when the centralized control apparatus 300 performs an electric power division operation and does not require real-time signal transmission. Thus, the data regarding the used electric power is most suitable for the processing performed in the transmission relay 400 instead of the centralized control apparatus 300. In addition, since each transmission relay 400 has to perform the data collection and storage operation only for the indoor units 200 connected through the second transmission line 510, the processing load and an amount of data to be stored can be distributed by a plurality of transmission relays 400. Furthermore, the load of processing that the centralized control apparatus 300 performs can be reduced.

Embodiment 2

In the above-described embodiment 1, the operation for collecting data regarding the used electric power that the transmission relay 400 performs has been described. The monitoring operation that the centralized control apparatus 300 performs employing the polling method is not limited to that on the data regarding the used electric power. For example, the polling method is also employed in an operation for monitoring occurrence of an abnormality in the indoor units 200. In this embodiment, an example of an operation for monitoring occurrence of an abnormality will be described. The system configuration or the like is the same as that described in the embodiment 1, thus description thereof is omitted.

A data processing unit 430B causes second transmission means 420 to transmit a request signal for abnormality determination. In an indoor unit 200 that has received the request signal by indoor unit communication means 220, indoor unit controlling means 210 performs a detection operation. Then, the indoor unit controlling means 210 causes the indoor unit communication means 220 to transmit a signal including the data regarding the detected abnormality determination (e.g., temperature at inlet or outlet of an indoor-unit-side heat exchanger 250, a rotation speed of an indoor-unit-side fan 260, and so on). Here, the signal including the data regarding the abnormality determination is transmitted. However, for example, the indoor unit 200 may perform a self-diagnostic operation to determine whether the indoor unit is in an abnormal state on the basis of the detected data, and may transmit a signal including the data of the result.

Second transmission means 420 receives the signal transmitted from each indoor unit 200 connected through the second transmission line 300. On the basis of the data included in the signal, the data processing unit 430B stores the data regarding the abnormality determination in the data storage means 440, and determines whether the abnormal state has occurred in the indoor unit 200. If the data processing unit 430B determines that the abnormal state does not occur, the data processing unit 430B performs the above-described operation for other indoor units 200 similarly to continue the monitoring operation for each indoor unit 200.

On the other hand, if the data processing unit 430B determines that the abnormal state has occurred, the data processing unit 430B causes the first transmission unit 300 to transmit a signal indicating the abnormal state together with the data regarding the abnormality determination for a past predetermined period. The centralized control apparatus 300 performs processing on the basis of the data included in the transmitted signal, and, for example, displays the abnormality information on the display device to inform users of the abnormality.

As described above, according to the air-conditioning system of the embodiment 2, each transmission relay 400 performs the monitoring operation for monitoring the abnormal state in the indoor units 200 connected through the second transmission line 510. Upon determining the indoor unit is in the abnormal state, the transmission relay 400 is configured to transmit the signal indicating the abnormality to the centralized control apparatus 300. Thus, the traffic over the first transmission line 500 can be reduced. In addition, a load of processing that the centralized control apparatus 300 performs can be reduced. In this embodiment, although the operation for monitoring the occurrence of the abnormality has been described, the procedure can be applied to other monitoring operations.

Embodiment 3

FIG. 7 is a diagram showing a configuration of an air-conditioning system according to an embodiment 3 of the present invention. This embodiment differs from the above-described embodiments in that power lines 720 (720*a* and 720*b*) capable of transmitting signal like the second transmission lines 510 are used instead of the power lines 710 for supplying electric power to each indoor unit 200.

In the air-conditioning systems according to the above-described embodiments, the second transmission lines 510 and the power lines 710 are constituted by different lines. In this embodiment, a necessity of wiring with a dedicated communication line is eliminated and a wiring cost can be reduced by configuring the power lines 720 to carry signals instead of the second transmission lines 510.

Methods for transmitting signals over the power line are not specified in particular. For example, to increase the noise resistance, communication employing a spread spectrum method may be performed, or communication employing a coupling method utilizing photodiodes may be performed.

Embodiment 4

FIG. 8 is a diagram showing a configuration of an air-conditioning system according to an embodiment 4 of the present invention. In this embodiment, communication is performed via radio waves (wireless) instead of the second transmission lines 510 used in the above-described embodiments. The communication method is not specified in particular. However, in this example, it is assumed that ZigBee (ZigBee is a registered trademark of Koninklijke Philips Electronics NV. hereinafter, simply referred to as ZigBee) is used as the radio communication method.

In this embodiment, radio wave communication means 290 (290*a* to 290*h*) and radio wave communication means 450 (450*a* and 450*b*) are provided in the indoor units 200 and the transmission relays 400 instead of the indoor unit communication means 220 and the second transmission means 420, respectively. In addition, this embodiment differs from the above-described embodiments in that the second transmission lines 510 are not arranged.

ZigBee is one of short-range wireless communication standards for home appliances. Although a communication speed of ZigBee is relatively low, a communication distance can be set longer (tens meters depending on radio wave transmission output) than that of other methods of the same kind. For example, with infrared rays, it is difficult to perform communication unless transmission means and reception means are provided in a range of an unobstructed view, for example. In a case where the communication is performed at least on each floor of a building, there are a few communication restrictions since ZigBee employs radio waves having the longer wave length than the infrared rays. In addition, ZigBee generally has characteristics that ZigBee is inexpensive and requires less power consumption. Additionally, ZigBee terminals can be connected by wireless to constitute a network. In this embodiment, basically, the radio wave communication means 450 of the transmission relay 400 can be connected by wireless with the indoor units 200 in a range that the radio waves directly reach. However, some ZigBee terminals (full functional devices) may have a relay function. For example, when the communication is performed between the terminals in a range that the radio waves do not directly reach, other terminal relays the signal, whereby the communication can be performed.

Here, in this embodiment, the radio wave communication means 450 performs transmission/reception of signals via radio waves not having directivity (nondirectional). However, in some cases, directional communication can be performed. In addition, herein, all of the indoor units 200 in the system can communicate with each other through wireless connection. However, for example, in a range that the radio waves do not reach, for example, the second transmission line 510 may be provided and the communication may be performed through the second transmission line. Both wired communication and wireless communication may be performed.

As described above, according to the system of the embodiment 4, since communication between each of the indoor units 200 and the transmission relay 400 is performed by wireless, the wiring of the transmission lines of the communication system can be eliminated or part of the wiring can be omitted. Thus, communication can be performed, for example, regardless of the arrangement of the refrigerant piping and the wiring of the power system, and without considering the thickness of the transmission lines. In addition, if the indoor unit 200 is added, communication link can be managed flexibly. For example, when various devices, such as temperature sensors, which perform communication with the indoor unit 200 are installed at a place away from the indoor unit 200 in a room, the same communication method such as ZigBee is employed in those devices, whereby cooperated communication can be performed and more advanced control and management can be performed.

Embodiment 5

FIG. 9 is a diagram showing a configuration of a transmission relay 400 according to an embodiment 5 of the present invention. The transmission relay 400 in the embodiment 1 and the transmission relay 400 in this embodiment differ in that the transmission relay 400 in this embodiment includes radio wave communication means 450 instead of the second transmission means 420, and an address setting processing unit 430C. The address setting processing unit 430C performs an address setting operation for indoor units 200 wirelessly connected thereto. In this case, the address setting processing unit 430C has a counter used for setting addresses and sets an address number of each indoor unit 200.

For example, to mange the indoor units 200 in the air-conditioning system, the address is set for each of the indoor units 200. Conventionally, this setting is performed by operators manually with an address switch or the like provided in the indoor units 200. In this embodiment, for example, the transmission relay 400 installed in each story (floor) performs the setting according to the wireless communication. Herein, the description is given while assuming that the indoor units 200 installed on the same floor constitute a group under the condition that radio waves reach (if radio waves do not reach directly, a relay antenna may be provided). On the other hand, it is assumed that the indoor units 200 installed on the different floors cannot constitute a group, because the radio waves are blocked by walls or the like and radio waves can not reach.

FIG. 10 is a diagram showing a flowchart for an address setting operation that the transmission relay 400 performs for each indoor unit 200. The address setting for the indoor units 200 in the embodiment will be described on the basis of FIG. 10. The system configuration is the same as that shown in FIG. 9 described in the embodiment 4. In addition, it is assumed that the refrigerant system data is stored in the system storage unit 441 of the transmission relay 400.

The address setting processing unit 430C of the transmission relay 400 set a counter 431 to an initial value (S41). In this example, the initial value of the counter is set to 0. However, a predetermined value may be set as the initial value. For example, the address in the communication system set for each transmission relay 400 may be set as the initial value. The address setting processing unit 430C transmits a signal regarding an address setting instruction for the indoor unit 200, whose address is not yet set, to the radio wave communication means 290 (S42).

In each indoor unit 200, when the radio wave communication means 290 receives the signal regarding the address setting instruction, control processing means 210 determines whether the address is set (S51). If the address is not set, the each indoor unit 200 transmits a reply signal through the radio wave communication means 290 (S52). Here, if the setting reply signal is transmitted from each indoor unit 200 at the same time, the address setting processing unit 430C cannot perform processing. Thus, the time differences are provided between the signal transmissions performed by each indoor unit 200. Herein, for example, a quarts oscillator 211 included in the control processing means 210 is used. For example, in terms of accuracy, there is an error in an oscillation frequency of the quartz oscillator 211. Thus, it is considered that there are no indoor units 200 having the oscillation frequencies completely agree. Accordingly, in this embodiment, for example, the control processing means 210 of each indoor unit 200 transmits the reply signal upon determining the number of times of oscillation of the quartz oscillator 211 becomes, for example, ten thousand times so that the time difference based on the error is sufficiently provided.

Upon receiving the reply signal transmitted from an indoor unit 200 (S43), the address setting processing unit 430C increments the value of the counter 431 by one, and sets the new value as the address data, and transmits a signal including the address data (S44). For example, the address data is stored in association with the refrigerant system data (S45). On the other hand, in the indoor unit 200, if the signal including the address data is transmitted (S53), the control processing means 700 stores the address data in the storage means 800 (S54).

The transmission relay 400 determines whether it has performed the address setting for all of the wirelessly connected indoor units 200 that are stored in the refrigerant system storage unit 441 (S46). If the transmission relay 400 determines that the setting is not performed, the process returns to S12, and transmits the signal regarding the address setting instruction to perform the address setting operation for the indoor unit 200 for which the address setting is not performed. By the above-described processing, the address is set sequentially for the indoor units 200 in order from the indoor unit having the quartz oscillator 211 whose oscillation frequency is higher.

Herein, although the address is set by numerals, the address is not limited to this, and the address can be set using characters, numerals, and other symbols as long as address can be set uniquely for each indoor unit 200 in a group (in a system when performing communication between the indoor units 200 in other groups).

As described above, according to the system of the embodiment 5, the address setting processing unit 430C of each transmission relay 400 is configured to perform the address setting operation for each indoor unit 200 wirelessly connected thereto. Thus, the address setting operation can be performed without providing the address switch in the indoor unit 200. In addition, since the address setting can be performed automatically, the operators do not have to perform the address setting operation manually.

Embodiment 6

FIG. 11 is a diagram showing a configuration of an air-conditioning system according to an embodiment 6 of the present invention. For example, in an air-conditioning system in a building or the like, a remote controller for transmitting operation instruction signals, such as operation mode instructions and room temperature setting instructions, to the indoor units 200 is often provided for each group of indoor units 200 or each indoor unit 200. In this embodiment, the function of the transmission relay 400 described in the above embodiments is installed in a remote controller 800.

FIG. 12 is a diagram showing a configuration of the remote controller 800. A first transmission unit 810 plays the same role as the first transmission means 410 of the above-described transmission relay 400. Similarly, a radio wave communication means 820 plays the same role as the above-described radio wave communication means 450.

A control processing means 830 includes a relay processing unit 830A, a data processing unit 830B, and an address setting processing unit 830C. Accordingly, as in the case of the transmission relay 400, the control processing means 830 can perform the above-described relay operation, monitoring operation (data collection, storage operation, etc.), and address setting operation. In addition, the control processing means 830 includes an operation processing unit 830D for performing processing based on signals from operation instruction input means 840 and a display processing unit 830E for generating display signals to causes display means 850 to display images.

The operation instruction input means 840 transmits signals based on instructions input from operators, such as, for example, a temperature setting instruction and operation mode (cooling, heating, ventilation, etc.) instructions to the control processing means 830. The display means 850 performs display of, for example, set temperature and operation mode, on the basis of the display signals resulting from the processing by the display processing unit 830E of the control processing means 830. As in the case of the data storage means 440, data storage means 860 stores data needed by the control processing means 830 to perform processing and data of the processing results. Regarding the monitoring operation and address setting operation that the remote controller 800 performs, the same operations as those described in the above embodiments are performed, thus the description thereof is omitted.

As described above, since the remote controller 800 is configured to perform the relay operation and data collection operation of the transmission relay 400 described in the above embodiment 1 and the like, there is no need for providing two devices, the transmission relay 400 and the remote controller 800, and the cost can be reduced. In addition, in the air-conditioning system of FIG. 10, the system is configured using the remote controller 800 having the functions of the transmission relay 400. However, the system configuration is not limited to this. For example, the system may be configured so that the remote controller 800 of this embodiment and the transmission relay 400 coexist.

Embodiment 8

FIG. 13 is a diagram showing a configuration of a wireless remote controller 900 (hereinafter, referred to as a wireless remote control 900) according to an embodiment 8 of the present invention. In FIG. 13, remote arithmetic processing means 910 performs control operations on other means in the wireless remote control 900 and processes data based on the input signals. Display means 920 performs a display operation based on display signals transmitted from the remote arithmetic processing means 910. Input means 930 has, for example, numeric and instruction buttons, and if the instructions and the numbers of the input addresses are input by the operators, input means 930 transmits signals including the inputted data, to the remote arithmetic processing means 910. Radio wave communication means 940 wirelessly transmits the signals including data that the remote arithmetic processing means 910 has processed. In addition, the radio wave communication means 940 receives the wirelessly transmitted signals and transmits the signals to the remote arithmetic processing means 910. Herein, it is assumed the radio wave communication means 940 can perform communication with the radio wave communication means 290 of each indoor unit 200. In addition, the radio wave communication means 940 has directivity. Accordingly, basically, the radio wave communication means 940 performs one-to-one communication with an indoor unit 200. Additionally, remote control data storage means 950 stores data needed by the remote arithmetic processing means 910 to perform processing.

In the above-described embodiment 5, the air-conditioning system capable of setting the address of each indoor unit 200 in the system by the address setting operation of the transmission relay 400 has been described. Herein, in addition, for example, since the address setting in the embodiment 5 is performed in the descending order of the oscillation frequency of the quartz oscillator 211, operators (administrators) may not know what kind of setting has performed. In addition, the set addresses may become irregular in terms of an arrangement of the indoor units 200 in the building (on the floor). Accordingly, for example, when an administrator displays the addresses on a management screen to confirm the addresses, it is inconvenient to manage the addresses if the set address numbers or the like are displayed irregularly.

Accordingly, in this embodiment, confirmation of the set addresses and the change or modification of the addresses can be performed by the wireless remote control 900 capable of performing communication of signals including the address data with each indoor unit 200 via radio waves.

For example, an operator of the wireless remote control 900 directs the radio wave communication means 940 to an indoor unit 200 and presses a confirmation instruction button provided on the input means 930. If the signal of the confirmation instruction is transmitted through the input means 930, the remote arithmetic processing means 910 causes the radio wave communication means 940 to transmit the signal including data of the confirmation instruction.

In the indoor unit 202, on the basis of the signal that the radio wave communication means 290 has received, the indoor unit controlling means 210 loads the address data from the indoor unit storage means 230, and causes the radio wave communication means 290 to transmit a signal including the address data.

On the basis of the signal that the radio wave communication means 940 has received, the remote arithmetic processing means 910 processes the address data, and transmits a display signal to the display means 920 to cause the display means 920 to display the address of the indoor unit 200.

Next, a case in which the address set for an indoor unit 200 is modified will be described. For example, the operator presses numeric buttons provided on the input means 930 to input the address number that the operator desires to set for the indoor unit 200. The signal including the data of the instructed number is transmitted to the remote arithmetic processing means 910. For example, processing means 99 transmits a display signal to cause the display means 920 to display the number. Then, the operator directs the radio wave communication means 940 of the wireless remote control 900 to an indoor unit 200, and presses a modification instruction button provided on the input means 930. The remote arithmetic processing means 910 causes the radio wave communication means 940 to transmit a signal including data of the modification instruction together with the data of instructed number.

In the indoor unit 202, on the basis of the signal that the radio wave communication means 290 has received, the indoor unit controlling means 210 processes the data of the instructed number and stores the data in the indoor unit storage means 230 as the address data.

As described above, according to the embodiment 7, the confirmation and modification of the address of the indoor unit 200 is performed using the wireless remote control 900. Thus, for example, even when the address is set for each indoor unit 200 automatically, the operator can confirm the address. In addition, in some cases, this configuration is convenient since the address can be changed arbitrarily. In particular, by performing the communication using radio waves having frequencies used in the above-described ZigBee instead of the infrared ray or the like, even if wireless communication means cannot be provided in a range of an unobstructed view, as in the case of the indoor unit 200 embedded in the ceiling, the operator can confirm or modify the address with the wireless remote control 900. In this embodiment, the wireless remote control 900 for performing confirmation and modification of the address has been described. However, for example, as in the case of the above-described remote controller 800, the signals of the temperature setting instruction and the operation mode instruction may be transmitted to the indoor units 200.

Embodiment 9

In the above-described embodiments, the air-conditioning systems have been described. However, for example, the present invention can be applied to a refrigeration system and a lighting system.

REFERENCE NUMERALS

Figure 1:
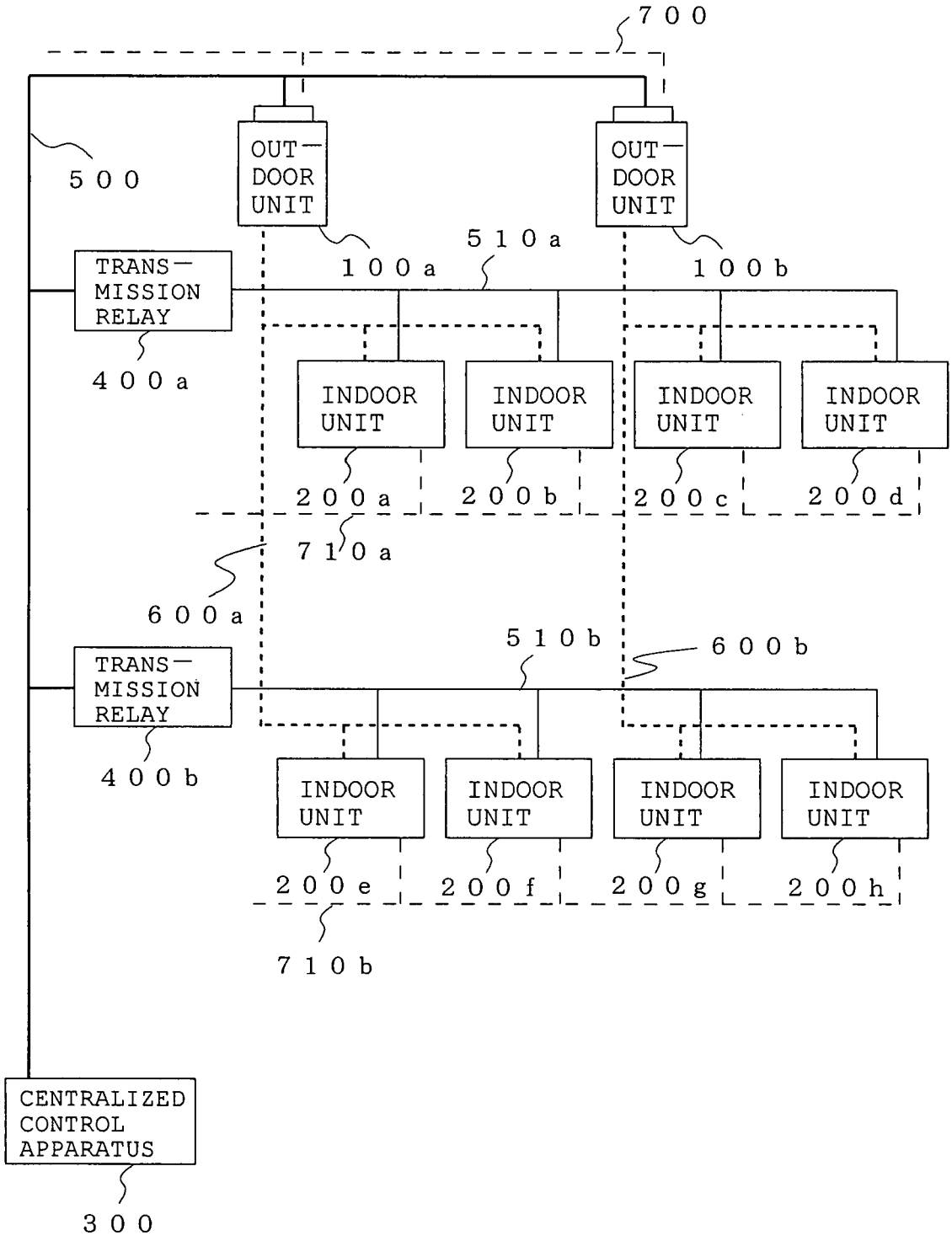
FIG. 1 is a diagram showing a configuration of an air-conditioning system according to an embodiment 1 of the present invention.
Figure 2:
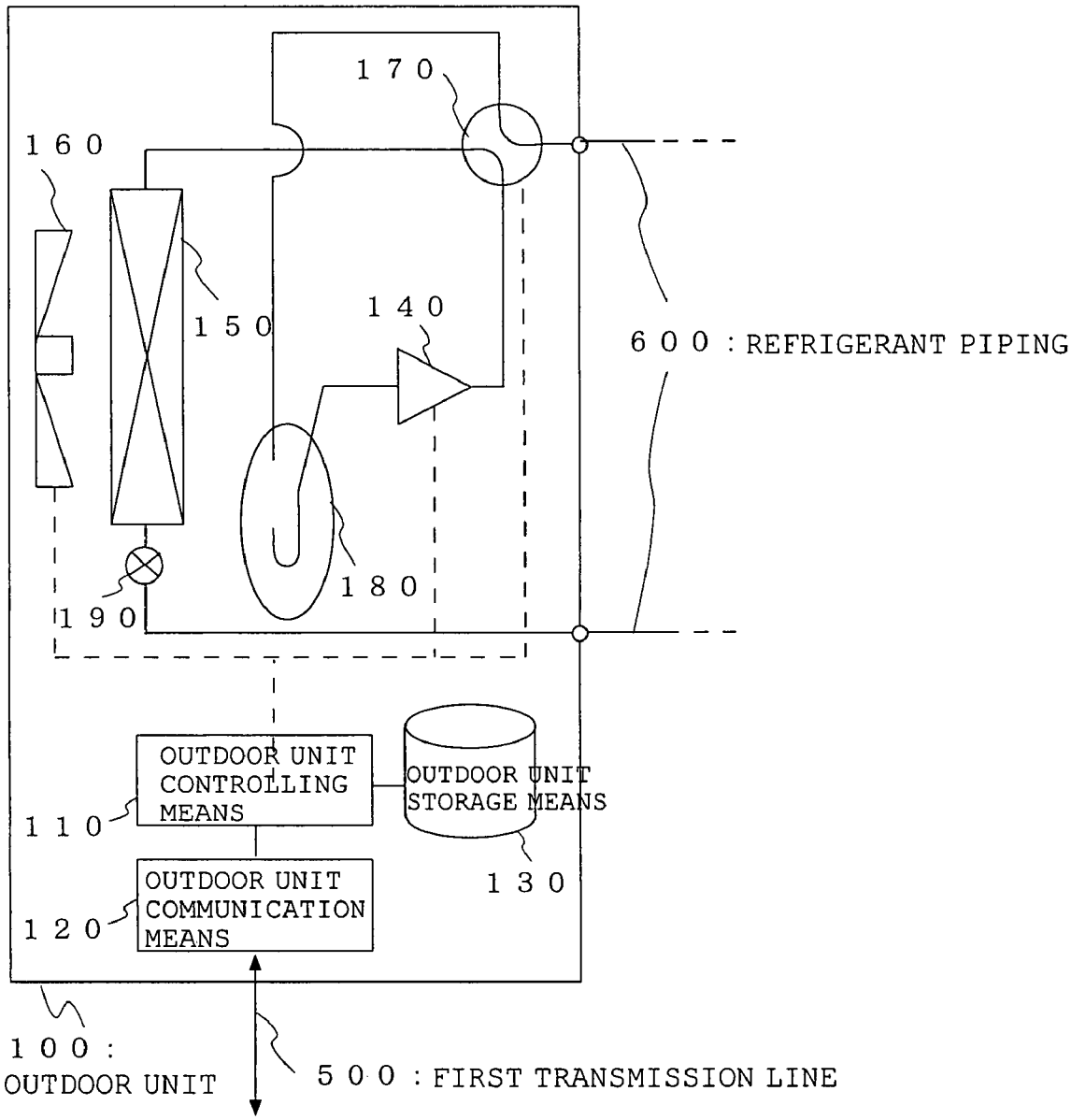
FIG. 2 is a diagram showing an example of a configuration of an outdoor unit 100.
Figure 3:
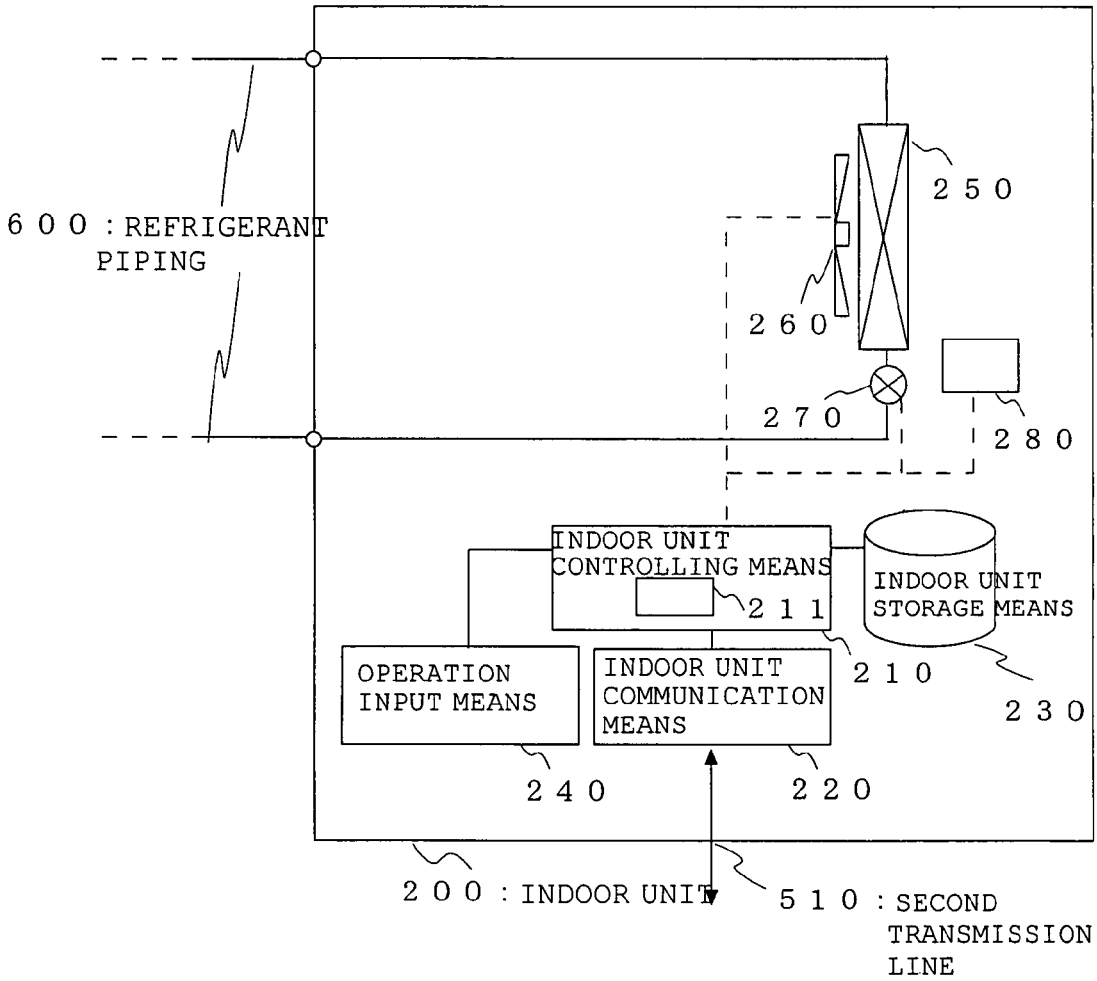
FIG. 3 is a diagram showing an example of a configuration of an indoor unit 200.
Figures 4, 5:
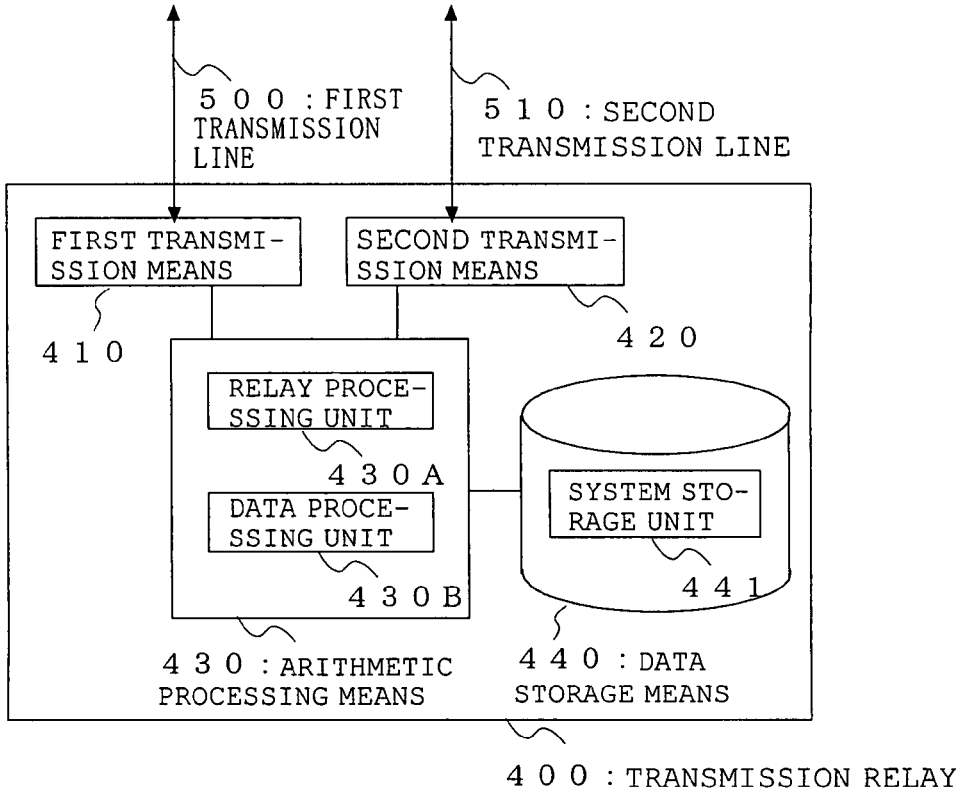
FIG. 4 is a diagram showing a configuration of a transmission relay 400.
FIG. 5 is a diagram showing a relationship in a refrigerant system.
Figure 6:
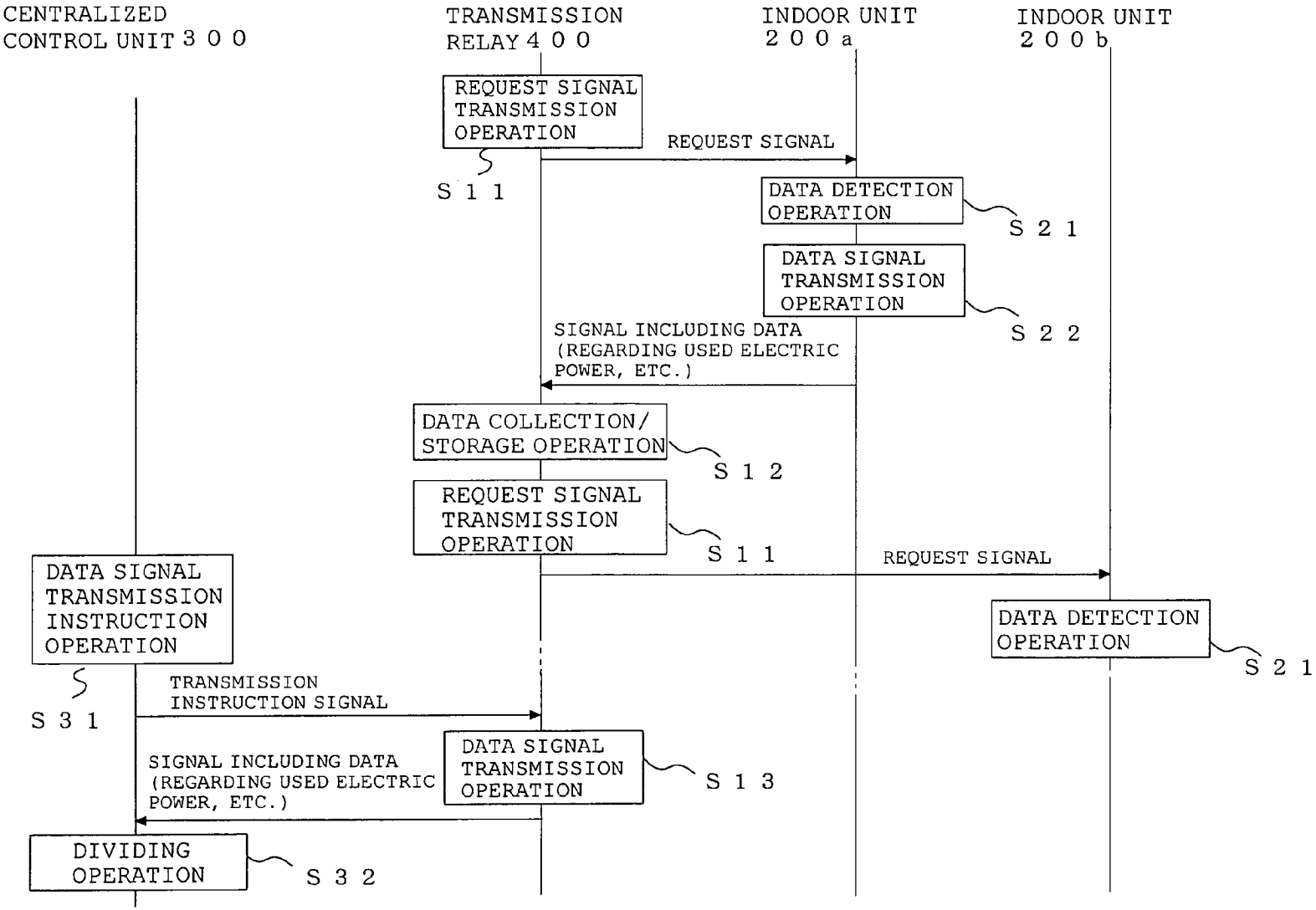
FIG. 6 is a diagram showing an example of data processing centered on a data processing unit 430B.
Figure 7:
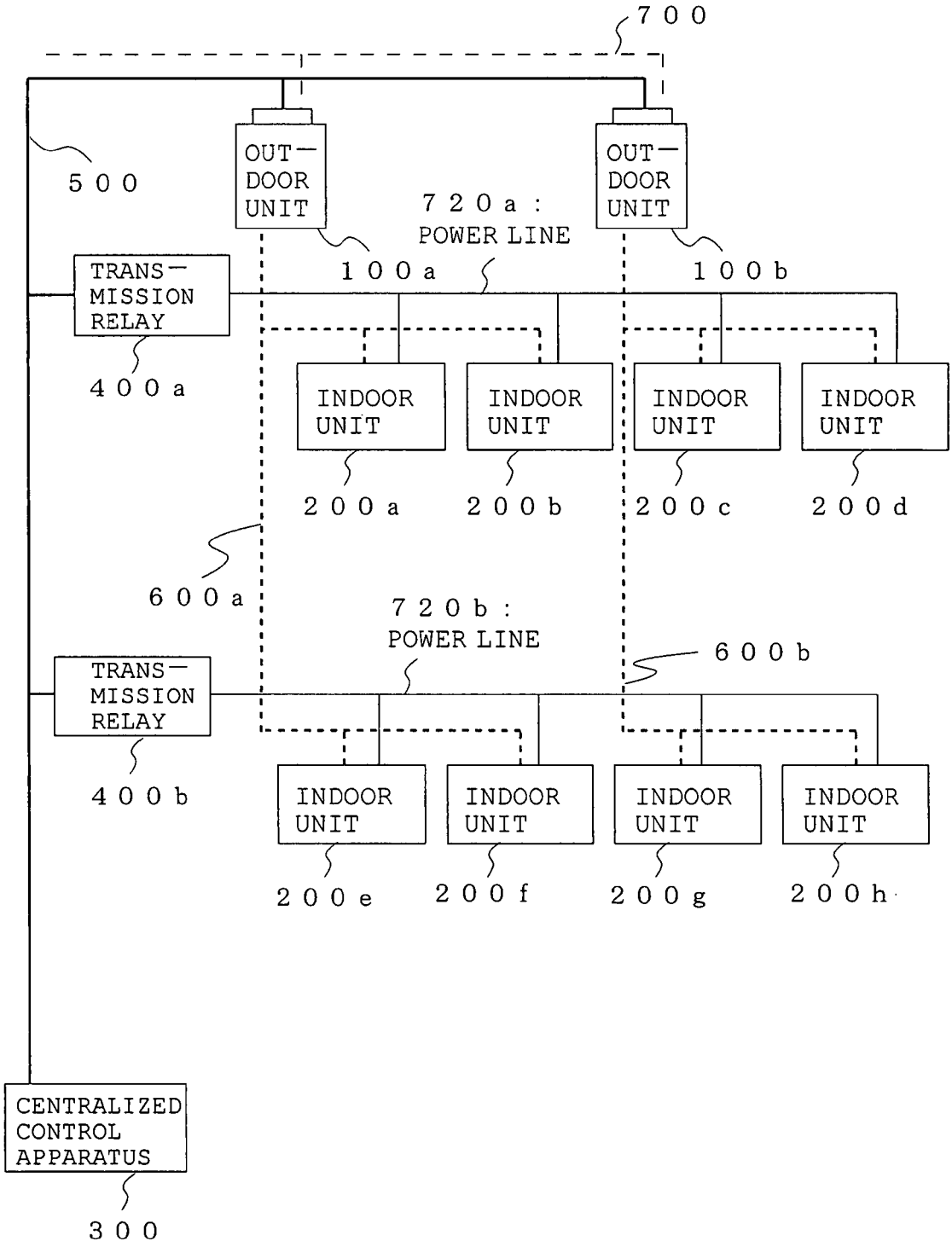
FIG. 7 is a diagram showing a configuration of an air-conditioning system according to an embodiment 3 of the present invention.
Figure 8:
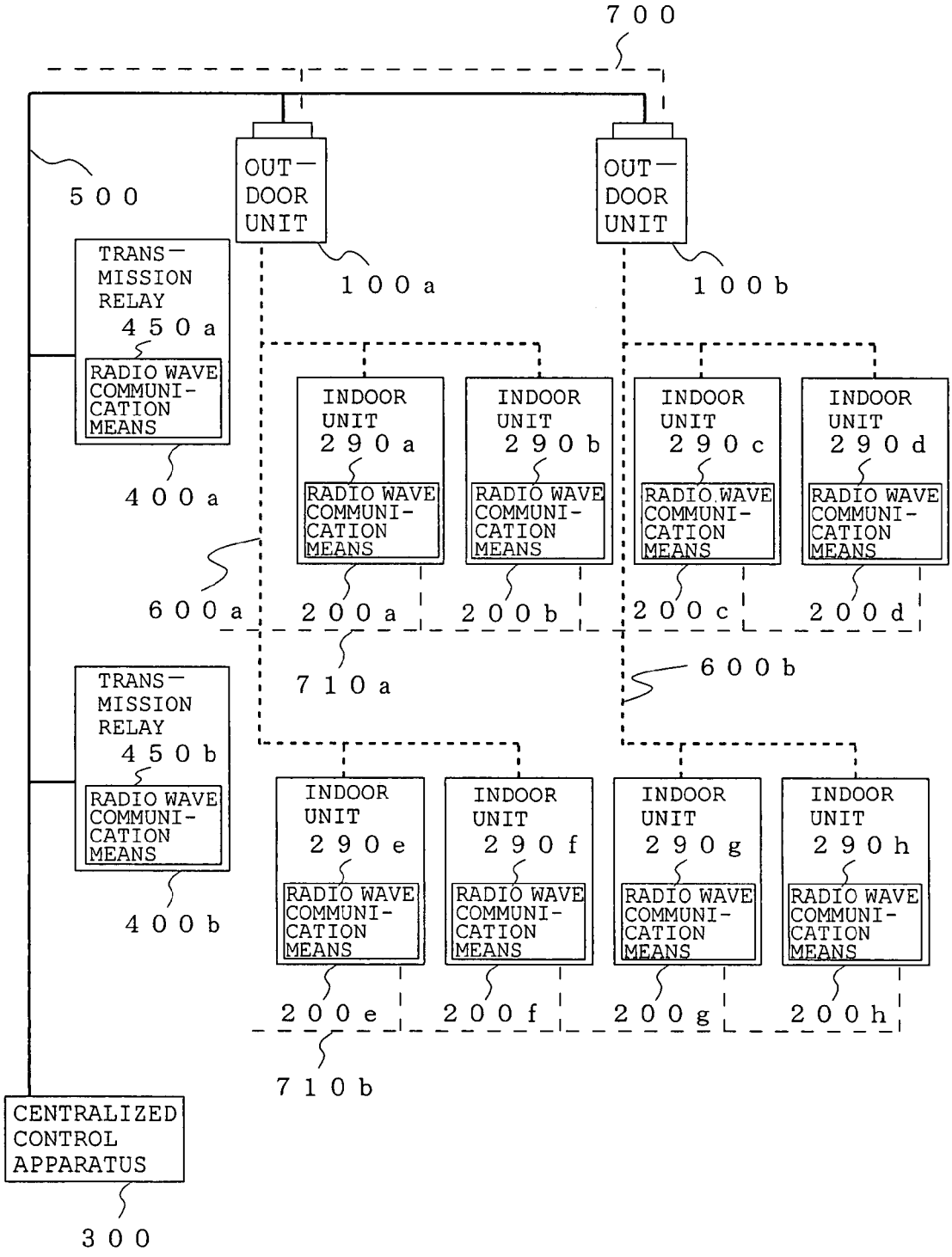
FIG. 8 is a diagram showing a configuration of an air-conditioning system according to an embodiment 4 of the present invention.
Figure 9:
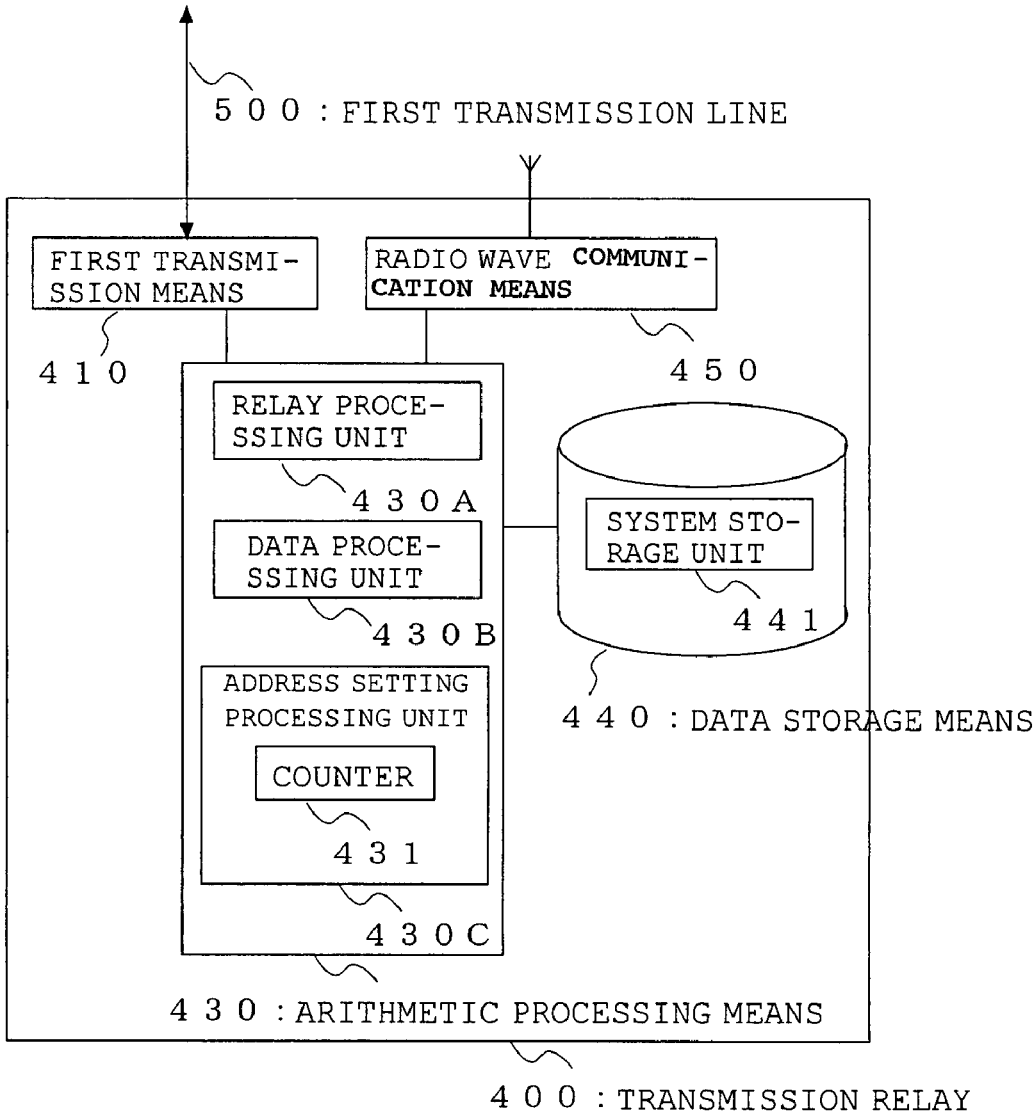
FIG. 9 is a diagram showing a configuration of a transmission relay 400 according to an embodiment 5 of the present invention.
Figure 10:
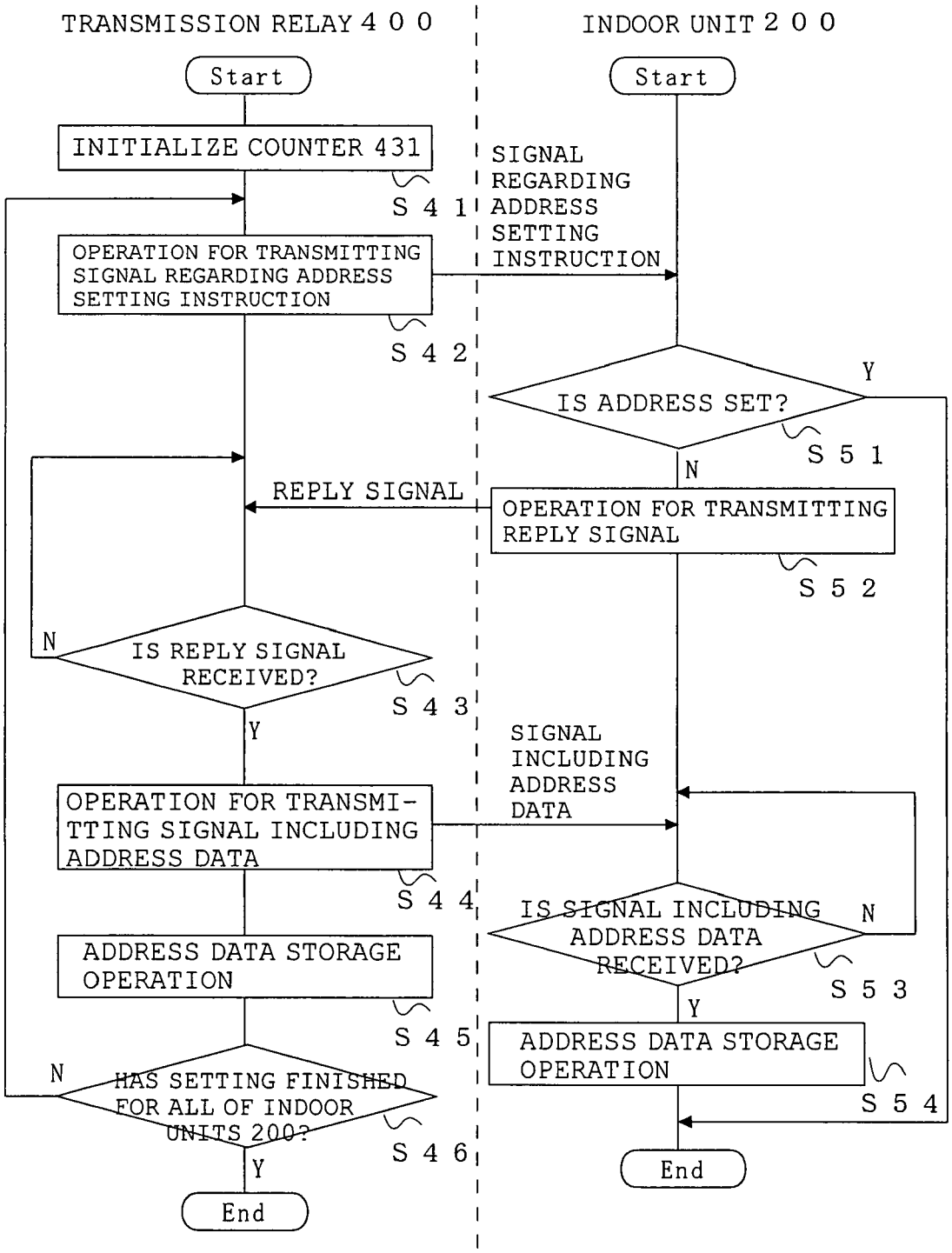
FIG. 10 is a diagram showing a flowchart for an address setting operation.
Figure 11:
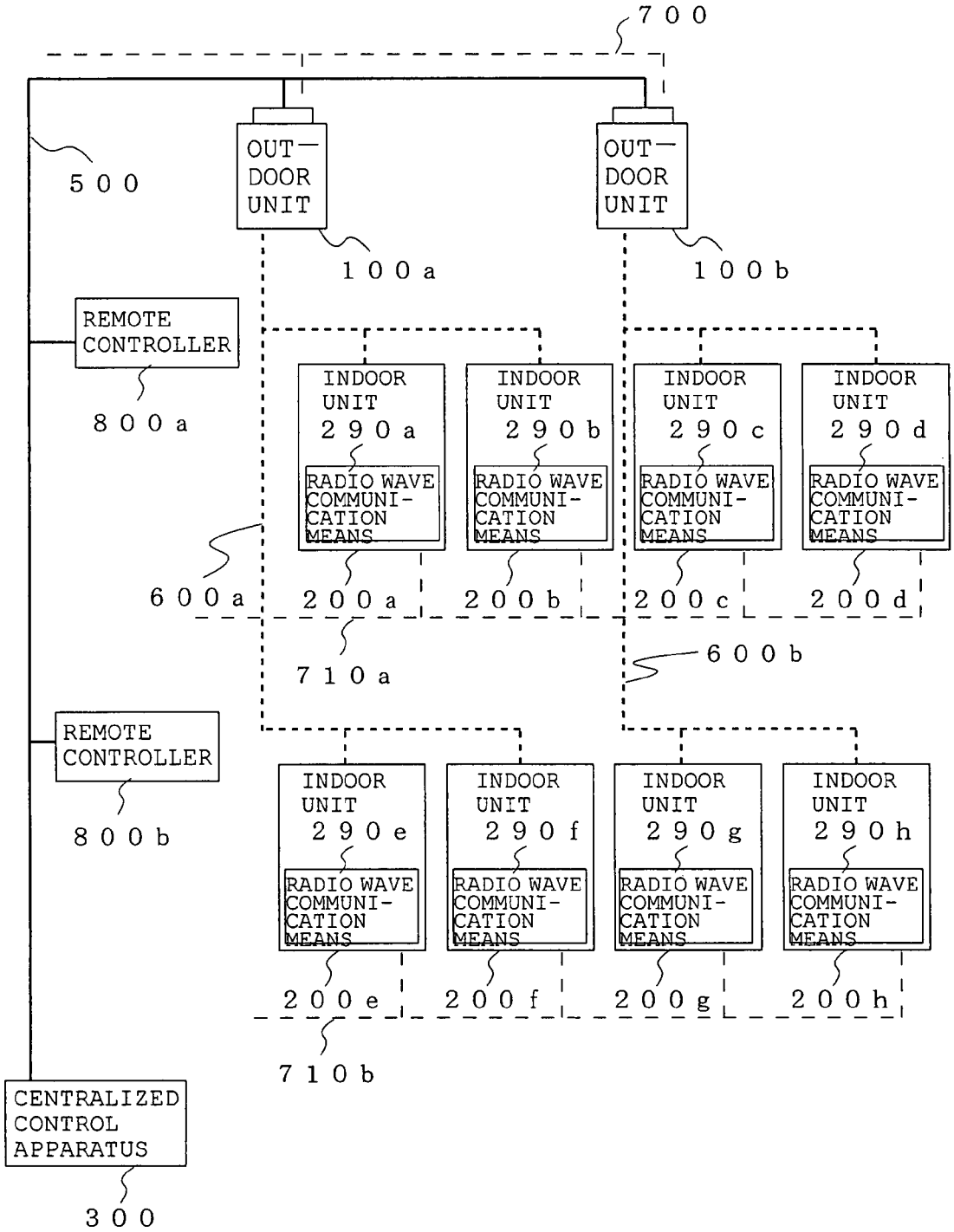
FIG. 11 is a diagram showing a configuration of an air-conditioning system according to an embodiment 6 of the present invention.
Figure 12:
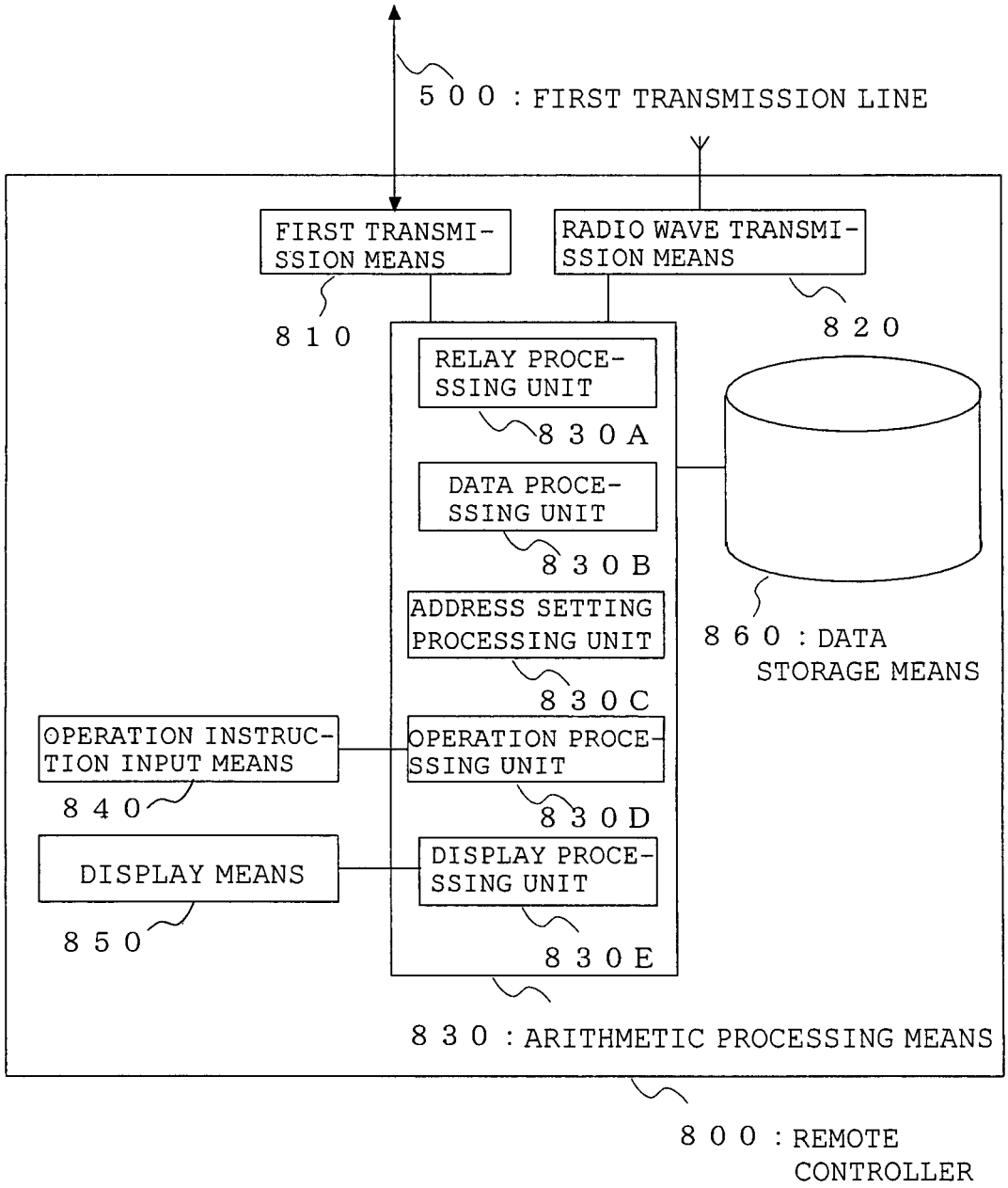
FIG. 12 is a diagram showing a configuration of a remote controller 800 according to an embodiment 7.
Figure 13:
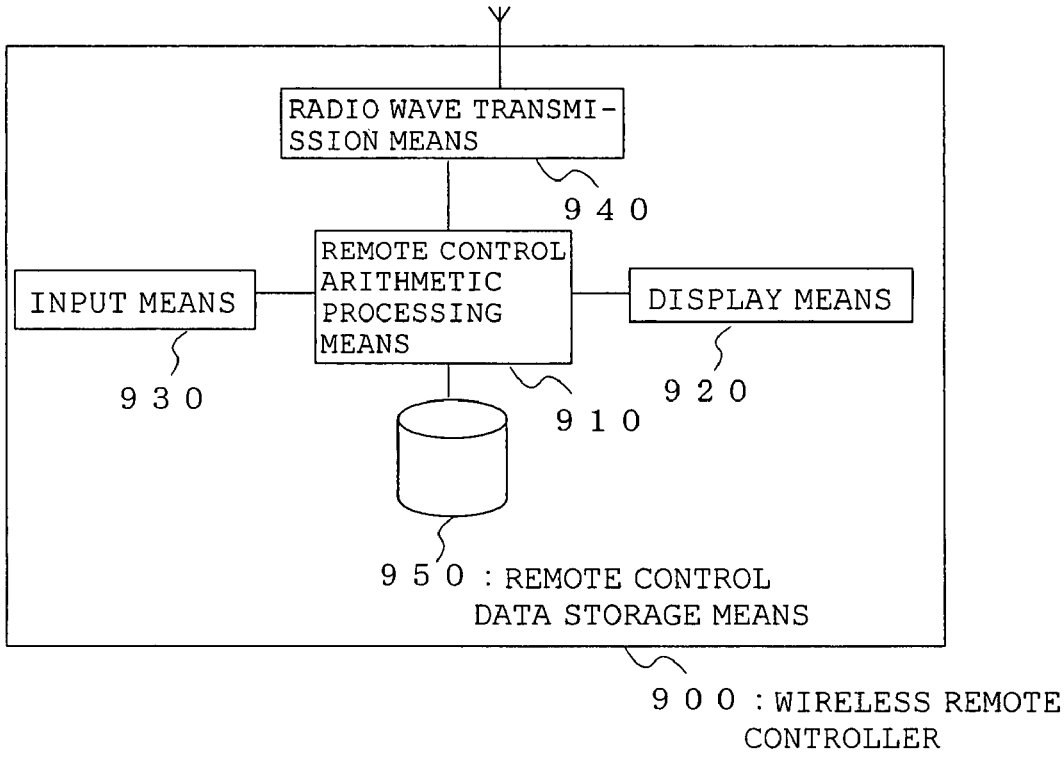
FIG. 13 is a diagram showing a configuration of a wireless remote controller 900 according to an embodiment 8.

100, 100*a*, 100*b* outdoor unit, 110 outdoor unit controlling means, 120 outdoor unit communication means, 130 outdoor unit storage means, 140 compressor, 150 outdoor-unit-side heat exchanger, 160 outdoor-unit-side fan, 170 four-way switching valve, 180 accumulator, 190 outdoor-unit-side expansion valve, 200, 200*a*-200*h* indoor unit, 210 indoor unit controlling means, 211 quartz oscillator, 220 indoor unit communication means, 230 indoor unit storage means, 240 operation input means, 250 indoor-unit-side heat exchanger, 260 indoor-unit-side fan, 270 indoor-unit-side expansion valve, 280 auxiliary heater, 290, 290*a*-290*h* radio wave communication means, 300 centralized control apparatus, 400, 400*a*, 400*b*, transmission relay, 410 first transmission means, 420 second transmission means, 430 arithmetic processing means, 430A relay processing unit, 430B data processing unit, 430C address setting unit, 431 counter, 440 data storage means, 441 system storage unit, 450, 450*a*, 450*b* radio wave communication means, 500 first transmission line, 510, 510*a*, 510*b* second transmission line, 600, 600*a*, 600*b* refrigerant piping, 700, 710*a*, 710*b*, 720, 720*a*, 720*b* power line, 800, 800*a*, 800*b* remote controller, 810 first transmission means, 820 radio wave communication means, 830 arithmetic processing means, 830A relay processing unit, 830B data processing unit, 830C address setting unit, 830D operation processing unit, 830E display processing unit, 840 operation instruction input means, 850 display means, 860 data storage means, 900 wireless remote controller, 910 remote control arithmetic processing means, display means, 930 input means, 940 radio wave communication means, 950 remote control data storage means.

The invention claimed is:

1. An air-conditioning system comprising one or more indoor units, one or more outdoor units, and a centralized control apparatus, each of the units and apparatus including communication means for transmitting and receiving signals to perform signal communication, a transmission relay between a first transmission line to which the one or more outdoor units and the centralized control apparatus are connected and a second transmission line to which one or more indoor units constituting a group are connected, wherein the transmission relay relays a signal between the first transmission line and the connected second transmission line, and the transmission relay further includes an arithmetic processor for processing data included in the signal transmitted via the connected second transmission line, and data storage means for storing data regarding the processing by the arithmetic processor.

2. The air-conditioning system according to claim 1, wherein the arithmetic processor requests the indoor units connected to the second transmission line to transmit a signal including predetermined data according to a polling method and processes the data included in the signal transmitted from each of the indoor units in response to the request.

3. The air-conditioning system according to claim 2, wherein the arithmetic processor sets data regarding electric power consumption used in the indoor units as the predetermined data, requests the indoor units to transmit the signal, processes the data regarding the electric power consumption based on the transmitted signal to store the data in the data storage means, and performs an operation for transmitting a signal including the data stored in the data storage means to the centralized control apparatus regularly or in response to a request from the centralized control apparatus.

4. The air-conditioning system according to claim 2, wherein the arithmetic processor sets data for determining whether the indoor units are in an abnormal state as the predetermined data, requests the indoor units to transmit the signal, determines whether each of the indoor units is in the abnormal state on the basis of the transmitted signal, and performs an operation for transmitting a signal indicating occurrence of the abnormal state to the centralized control apparatus upon determining that at least one indoor unit is in the abnormal state.

5. The air-conditioning system according to claim 1, wherein a power line for supplying electric power to the indoor units constituting the group is used as the second transmission line.

6. The air-conditioning system according to claim 1, wherein each of the indoor units and the transmission relay includes radio wave communication means, and performs wireless communication via radio waves instead of the communication via the second transmission line.

7. The air-conditioning system according to claim 6, wherein the arithmetic processor further performs an address setting operation for setting addresses to the indoor units capable of performing the wireless communication via radio waves.

8. The air-conditioning system according to claim 7, wherein the air-conditioning system includes a wireless remote controller that performs the wireless communication between the controller and the indoor units via radio waves, displays the addresses set to the indoor units on display means, and modifies the addresses according to an instruction input with input means.

9. The air-conditioning system according to claim 1, wherein the transmission relay is provided in a remote controller provided for each group or in each of the indoor units to operate the indoor units.

* * * * *